US012607355B2

(12) United States Patent
Rajaram et al.

(10) Patent No.: US 12,607,355 B2
(45) Date of Patent: Apr. 21, 2026

(54) COMBUSTOR WITH RESONATOR FOR GAS TURBINE ENGINE

(71) Applicant: Siemens Energy Global GmbH & Co. KG, Munich (DE)

(72) Inventors: Rajesh Rajaram, Winter Park, FL (US); Sebastian Hermeth, Berlin (DE); Ayan Nath, Kolkata (IN); Sebastian Pfadler, Meerbusch (DE); Peter Kaufmann, Moers (DE); Jens Kleinfeld, Mülheim an der Ruhr (DE); Jens Fischer, Berlin (DE); Saurav Kumar Agarwal, Jamshedpur (IN)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 60 days.

(21) Appl. No.: 18/799,240

(22) Filed: Aug. 9, 2024

(65) Prior Publication Data

US 2025/0060105 A1 Feb. 20, 2025

Related U.S. Application Data

(60) Provisional application No. 63/519,283, filed on Aug. 14, 2023.

(51) Int. Cl.
*F23R 3/00* (2006.01)

(52) U.S. Cl.
CPC .... *F23R 3/002* (2013.01); *F23R 2900/00014* (2013.01)

(58) Field of Classification Search
CPC .. F23R 2900/00014; F23R 2900/00013; F23R 3/002; F05D 2260/963; F05D 2260/964; F05D 2230/31; F05D 2230/311; F05D 2230/312
See application file for complete search history.

(56) References Cited

U.S. PATENT DOCUMENTS

| | | | | |
|---|---|---|---|---|
| 9,400,108 | B2 | 7/2016 | Bilbao et al. | |
| 9,410,484 | B2 * | 8/2016 | Schilp | F02C 7/12 |
| 2002/0066272 | A1 | 6/2002 | Suenaga et al. | |
| 2005/0034918 | A1 | 2/2005 | Bland et al. | |
| 2006/0059913 | A1 | 3/2006 | Bethke et al. | |
| 2007/0169992 | A1 * | 7/2007 | Wasif | F23M 20/005 181/293 |

(Continued)

FOREIGN PATENT DOCUMENTS

| | | | |
|---|---|---|---|
| DE | 102015216772 | A1 | 3/2017 |
| WO | 2019018673 | A1 | 1/2019 |

*Primary Examiner* — Thuyhang N Nguyen
(74) *Attorney, Agent, or Firm* — Ye Ren

(57) ABSTRACT

A combustor includes a wall that defines a combustor interior to receive a fluid. The combustor also includes a slot that extends through the wall. The combustor also includes a resonator coupled to the wall. The resonator includes a resonator box defining a resonator interior between the wall and the resonator box, and a resonator segment disposed within the resonator box. The resonator segment includes a resonator neck having a resonator inlet and resonator outlet, the resonator inlet positioned within the resonator interior, the resonator outlet in flow communication with the combustor interior through the slot. The resonator neck defines a nonlinear flow path between the resonator inlet and the resonator outlet.

18 Claims, 5 Drawing Sheets

(56) References Cited

U.S. PATENT DOCUMENTS

| | | | | |
|---|---|---|---|---|
| 2009/0084100 | A1 | 4/2009 | Johnson et al. | |
| 2010/0206664 | A1 | 8/2010 | Bagnall | |
| 2010/0236245 | A1* | 9/2010 | Johnson | F23M 20/005 60/725 |
| 2012/0006028 | A1 | 1/2012 | Lee et al. | |
| 2018/0156460 | A1* | 6/2018 | Theuer | B33Y 10/00 |
| 2018/0180288 | A1* | 6/2018 | Kugimiya | F23R 3/42 |
| 2020/0232357 | A1* | 7/2020 | Bertoldi | F01N 1/023 |
| 2023/0366547 | A1* | 11/2023 | Nath | F23R 3/002 |

* cited by examiner

COMBUSTOR WITH RESONATOR FOR GAS TURBINE ENGINE

BACKGROUND

A gas turbine engine typically includes a compressor section, a turbine section, and a combustion section disposed therebetween. The compressor section includes multiple stages of rotating compressor blades and stationary compressor vanes. The combustion section typically includes a plurality of combustors. The turbine section includes multiple stages of rotating turbine blades and stationary turbine vanes. Turbine blades and vanes often operate in a high temperature environment and are internally cooled.

During operation of the gas turbine engine, dynamics often occurs in the combustors. The dynamics may restrict the tuning flexibility of the gas turbine engine in order to operate at low emissions. The combustors may include resonators to damp the dynamics.

BRIEF SUMMARY

In one aspect, a combustor is provided. The combustor includes a wall that defines a combustor interior to receive a fluid. The combustor also includes a slot that extends through the wall. The combustor also includes a resonator coupled to the wall. The resonator includes a resonator box defining a resonator interior between the wall and the resonator box, and a resonator segment disposed within the resonator box. The resonator segment includes a resonator neck having a resonator inlet and resonator outlet, the resonator inlet positioned within the resonator interior, the resonator outlet in flow communication with the combustor interior through the slot. The resonator neck defines a nonlinear flow path between the resonator inlet and the resonator outlet.

In one aspect, a method for assembling a combustor is provided. The method includes forming a resonator segment including a plurality of resonator necks, each resonator neck of the plurality of resonator necks including a resonator inlet and a resonator outlet, each resonator neck defining a nonlinear flow path between the resonator inlet and the resonator outlet. The method also includes positioning the resonator segment on a wall of the combustor, the wall defining a combustor interior to receive a fluid, the wall having a slot extending through the wall, the resonator segment positioned such that the resonator outlet in flow communication with the combustor interior through the slot. The method also includes connecting a resonator box to the wall, the resonator segment disposed within the resonator box, the resonator segment and the resonator box cooperating defining a resonator.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
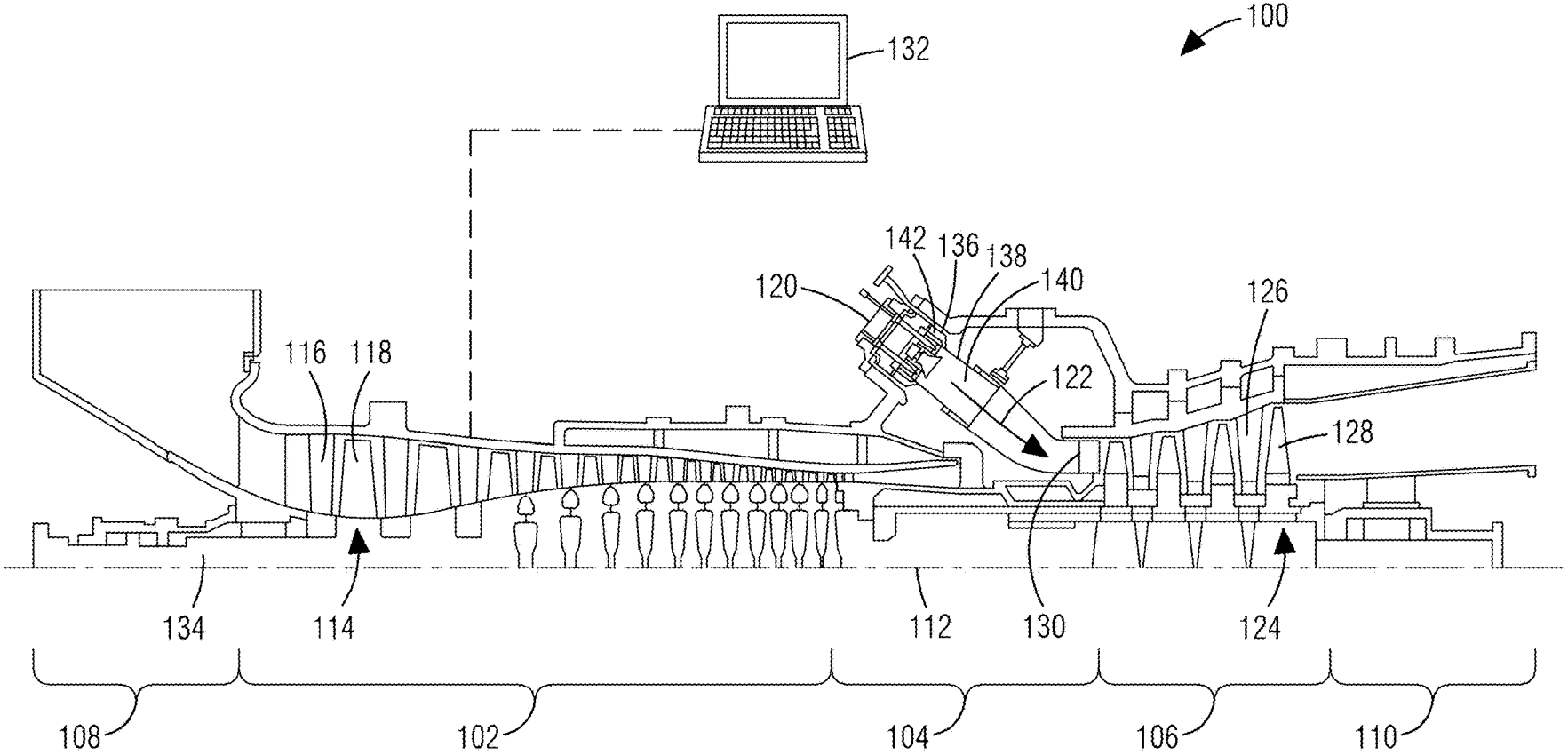
FIG. 1 is a longitudinal cross-sectional view of a gas turbine engine taken along a plane that contains a longitudinal axis or central axis.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including", "having", and "comprising", as well as derivatives thereof, mean inclusion without limitation. The singular forms "a", "an", and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith" as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

Also, in the description, the terms "axial" or "axially" refer to a direction along a longitudinal axis of a gas turbine engine. The terms "radial" or "radially" refer to a direction perpendicular to the longitudinal axis of the gas turbine engine. The terms "downstream" or "aft" refer to a direction along a flow direction. The terms "upstream" or "forward" refer to a direction against the flow direction.

In addition, the term "adjacent to" may mean that an element is relatively near to but not in contact with a further element or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

FIG. 1 illustrates an example of a gas turbine engine 100 including a compressor section 102, a combustion section 104, and a turbine section 106 arranged along a central axis 112. The compressor section 102 includes a plurality of compressor stages 114 with each compressor stage 114 including a set of stationary compressor vanes 116 or adjustable guide vanes and a set of rotating compressor blades 118. A rotor 134 supports the rotating compressor blades 118 for rotation about the central axis 112 during operation. In some constructions, a single one-piece rotor 134 extends the length of the gas turbine engine 100 and is supported for rotation by a bearing at either end. In other constructions, the rotor 134 is assembled from several separate spools that are attached to one another or may include multiple disk sections that are attached via a bolt or plurality of bolts.

The compressor section 102 is in fluid communication with an inlet section 108 to allow the gas turbine engine 100 to draw atmospheric air into the compressor section 102. During operation of the gas turbine engine 100, the compressor section 102 draws in atmospheric air and compresses that air for delivery to the combustion section 104. The illustrated compressor section 102 is an example of one compressor section 102 with other arrangements and designs being possible.

In the illustrated construction, the combustion section 104 includes a plurality of separate combustors 120. Each combustor 120 includes a flow sleeve 136 and a combustor liner 138. The combustor liner 138 surrounds a combustor chamber 140. An inlet portion of the combustor liner 138 is surrounded by the flow sleeve 136 defining a compressed air plenum 142 therebetween. The compressed air from the compressor section 102 flows through the compressed air plenum 142 and enter the combustor chamber 140 to mix a flow of fuel. The mixture of fuel and air is combusted in the combustor chamber 140 to produce a flow of high temperature, high pressure combustion gases or exhaust gas 122. Of course, many other arrangements of the combustion section 104 are possible.

The turbine section 106 includes a plurality of turbine stages 124 with each turbine stage 124 including a number of stationary turbine vanes 126 and a number of rotating turbine blades 128. The turbine stages 124 are arranged to receive the exhaust gas 122 from the combustion section 104 at a turbine inlet 130 and expand that gas to convert thermal and pressure energy into rotating or mechanical work. The turbine section 106 is connected to the compressor section 102 to drive the compressor section 102. For gas turbine engines 100 used for power generation or as prime movers, the turbine section 106 is also connected to a generator, pump, or other device to be driven. As with the compressor section 102, other designs and arrangements of the turbine section 106 are possible.

An exhaust portion 110 is positioned downstream of the turbine section 106 and is arranged to receive the expanded flow of exhaust gas 122 from the final turbine stage 124 in the turbine section 106. The exhaust portion 110 is arranged to efficiently direct the exhaust gas 122 away from the turbine section 106 to assure efficient operation of the turbine section 106. Many variations and design differences are possible in the exhaust portion 110. As such, the illustrated exhaust portion 110 is but one example of those variations.

A control system 132 is coupled to the gas turbine engine 100 and operates to monitor various operating parameters and to control various operations of the gas turbine engine 100. In preferred constructions the control system 132 is typically micro-processor based and includes memory devices and data storage devices for collecting, analyzing, and storing data. In addition, the control system 132 provides output data to various devices including monitors, printers, indicators, and the like that allow users to interface with the control system 132 to provide inputs or adjustments. In the example of a power generation system, a user may input a power output set point and the control system 132 may adjust the various control inputs to achieve that power output in an efficient manner.

The control system 132 can control various operating parameters including, but not limited to variable inlet guide vane positions, fuel flow rates and pressures, engine speed, valve positions, generator load, and generator excitation. Of course, other applications may have fewer or more controllable devices. The control system 132 also monitors various parameters to assure that the gas turbine engine 100 is operating properly. Some parameters that are monitored may include inlet air temperature, compressor outlet temperature and pressure, combustor outlet temperature, fuel flow rate, generator power output, bearing temperature, and the like. Many of these measurements are displayed for the user and are logged for later review should such a review be necessary.

Figure 2:
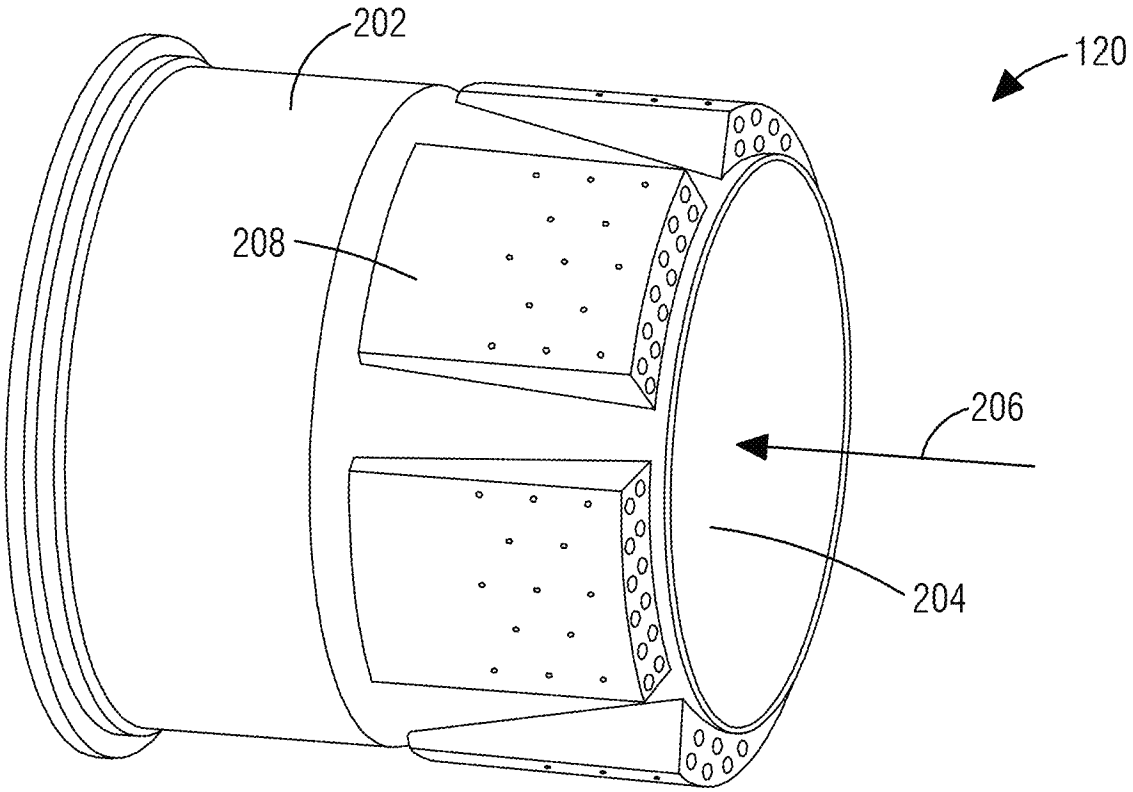
FIG. 2 is a perspective view of a portion of a combustor of FIG. 1.

FIG. 2 illustrates a perspective view of a portion of the combustor 120 of FIG. 1. The combustor 120 includes a wall 202 that surrounds a combustor interior 204. A fluid 206 flows through the combustor interior 204. The wall 202 may be the combustor liner 138 and the combustor interior 204 is the combustor chamber 140 and the fluid 206 is the exhaust gas 122. The wall 202 may the flow sleeve 136 and the combustor interior 204 is the compressed air plenum 142 and the fluid 206 is the compressed air from the compressor section 102.

The combustor 120 includes a plurality of resonators 208 that are coupled to the wall 202. Each resonator 208 of the plurality of resonators 208 is arranged circumferentially spaced apart from each other around the wall 202. The resonators 208 attenuates frequency dynamics, such as low frequency dynamics, intermediate frequency dynamics, or high frequency dynamics. The resonator 208 may be Helmholtz resonators, or any other resonators suitable for the combustor 120.

Figure 3:
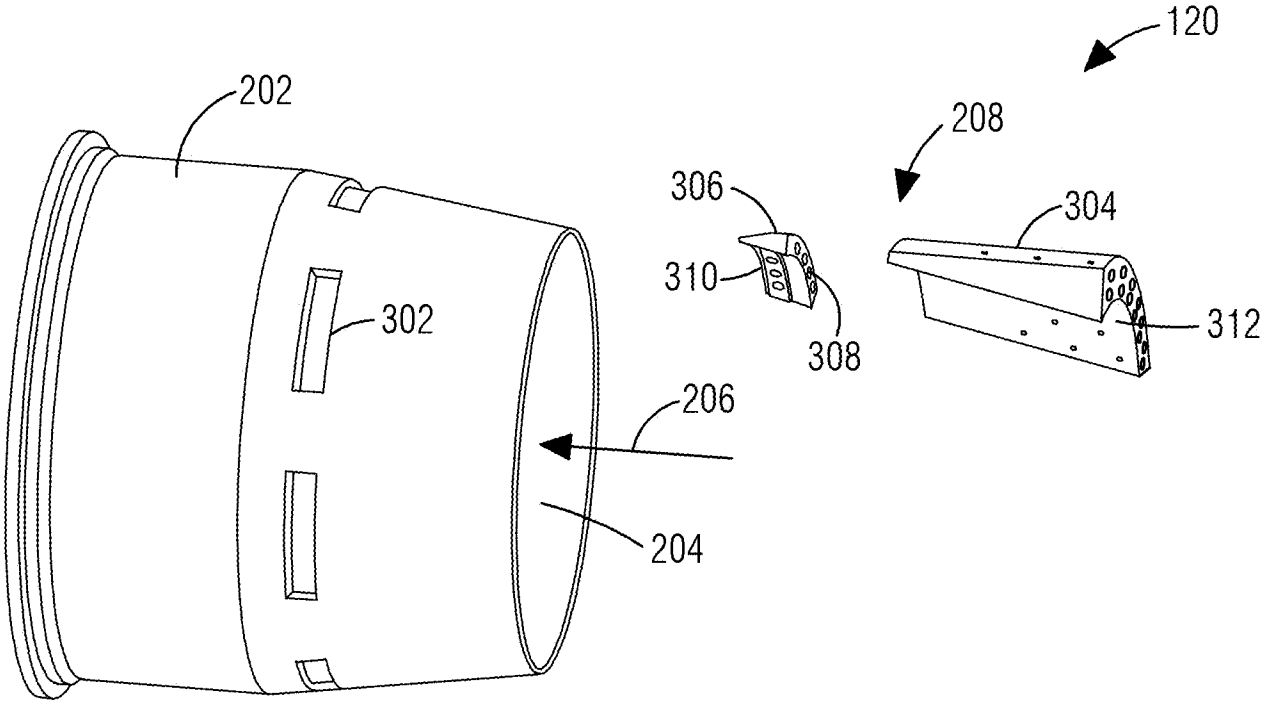
FIG. 3 is a perspective exploded view of the portion of the combustor of FIG. 2 showing one resonator.

FIG. 3 illustrates a perspective exploded view of the portion of the combustor 120 of FIG. 2 showing one resonator 208 of the plurality of resonators 208. The wall 202 includes a plurality of slots 302 that extends through the wall 202. A total number of slots 302 equals a total number of the resonators 208. Each slot 302 of the plurality of slots 302 is rectangular in shape. The plurality of slots 302 are arranged circumferentially around the wall 202 and evenly spaced apart from each other. The plurality of slots 302 are identical with each other. In other constructions, the plurality of slots 302 may have different configurations. For example, the plurality of slots 302 may have a shape other than rectangular, such as diamond, hexagon, octagon, circle, ellipse, etc. Additionally, each slot 302 of the plurality of slots 302 may not have the same shape or size as the other slots 302 and/or may be unevenly distributed around the wall 202.

For illustration purpose, only one resonator 208 of the plurality of resonators 208 is shown in FIG. 3. The resonator 208 includes a resonator box 304 and a resonator segment 306. The resonator box 304 is attached to the wall 202 to enclose a corresponding resonator segment 306. A resonator interior 312 is defined between the wall 202 and the resonator box 304. The resonator box 304 is attached to the wall 202 by welding, with other joining methods possible.

The resonator segment 306 includes a plurality of resonator inlets 308 and a plurality of resonator outlets 310. In the construction illustrated in FIG. 3, the resonator segment 306 has four resonator outlets 310 and four resonator inlets 308. Each resonator segment 306 is identical with the other resonator segments 306. In other constructions, the resonator segment 306 may have more or less than four resonator outlets 310 and four resonator inlets 308. Additionally, each resonator segment 306 may have different configuration from the other resonator segments 306, such as different shape, different size, or different numbers of resonator outlets 310 and resonator inlets 308.

Figure 6:
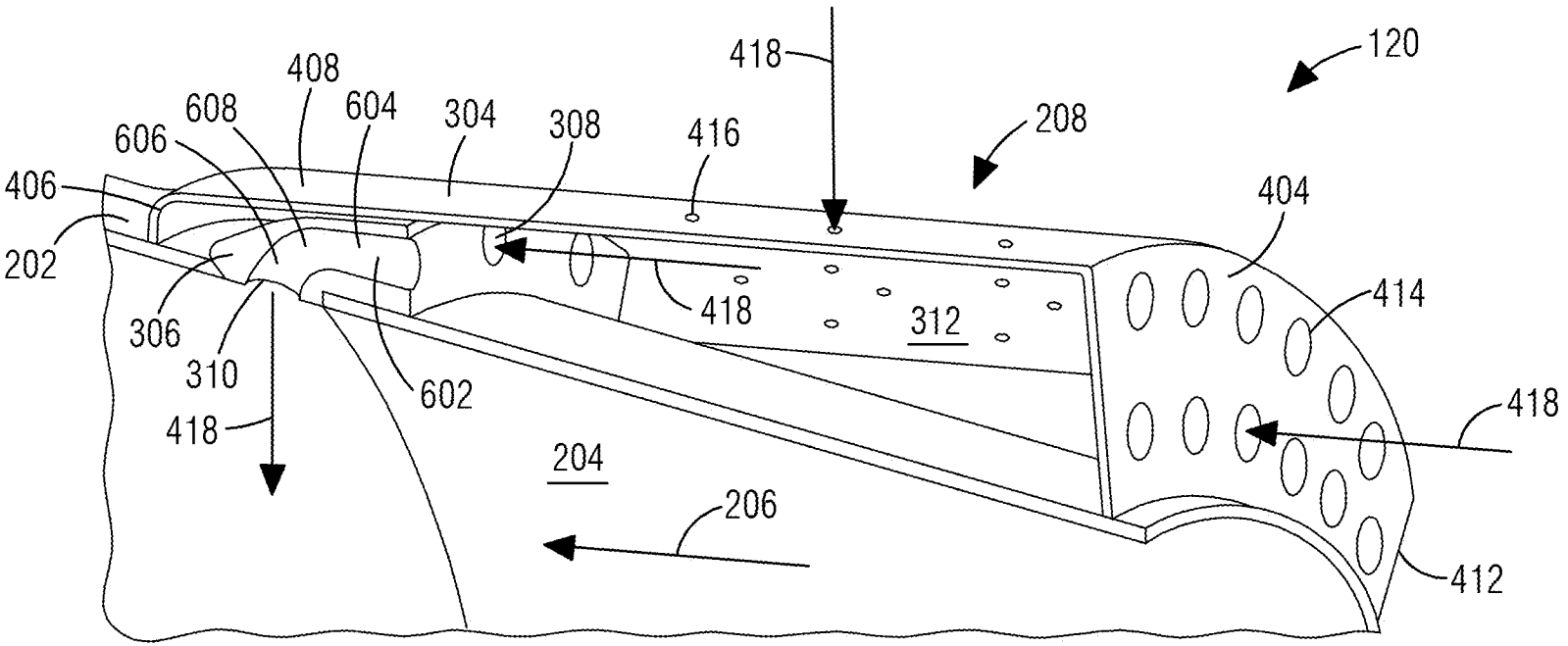
FIG. 6 is a perspective cutout view of the portion of the combustor of FIG. 2.

As illustrated and further described with regard to FIG. 6, a resonator neck 602 connects each of the resonator inlet 308 with a corresponding resonator outlet 310. When assembled, the resonator segment 306 is attached to the wall 202 to cover the slot 302 such that the plurality of resonator outlets 310 are in flow communication with the combustor interior 204. The plurality of resonator inlets 308 are positioned within the resonator interior 312. The resonator segment 306 is attached to the wall 202 by welding, with other joining methods possible.

Figure 4:
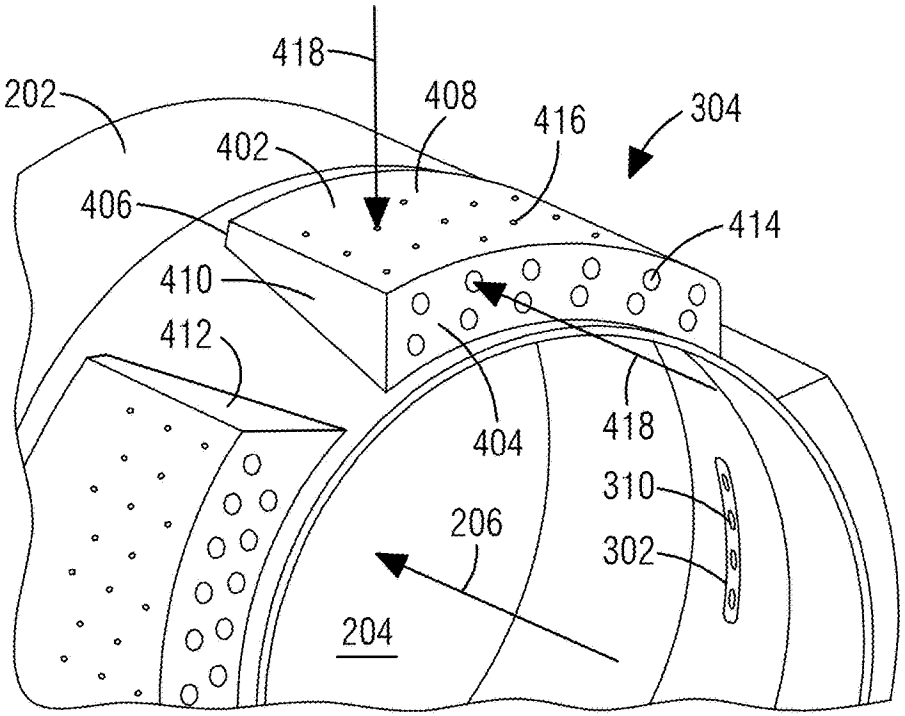
FIG. 4 is a perspective view of a resonator box of the resonator of FIG. 3 in an operating position.

FIG. 4 is a perspective view of the resonator box 304 of FIG. 3 in an operating position. The resonator box 304 includes an outer shell 402, an upstream plate 404 that is positioned on an upstream side of the outer shell 402 with respect to the flow direction of the fluid 206, a downstream plate 406 that is positioned on a downstream side of the outer shell 402 with respect to the flow direction of the fluid 206. The upstream plate 404 is a planar plate that also includes an inner curved edge, an outer curved edge, a first straight edge, and a second straight edge. The inner curved edge of the upstream plate 404 is arranged to match the contour of the wall 202 and is attached to the wall 202. The outer curved edge of the upstream plate 404 is parallel to the inner curved edge of the upstream plate 404 and spaced radially outward. The downstream plate 406 is a planar plate that includes an inner curved edge, an outer curved edge, a first straight edge, and a second straight edge. The inner curved edge of the downstream plate 406 is arranged to match the contour of the wall 202 and is attached to the wall 202. The outer curved edge of the downstream plate 406 is parallel to the inner curved edge of the downstream plate 406 and spaced radially outward.

The outer shell 402 includes a top surface 408, a first side surface 410, and a second side surface 412 that cooperate to define a U-shape. The top surface 408 has a curved shape that is substantially parallel to the wall 202 with a larger radius than the wall 202. The first side surface 410 and the second side surface 412 are planar surfaces. The first side surface 410 is positioned oblique to the top surface 408. The second side surface 412 is positioned oblique to the top surface 408. In other constructions, the first side surface 410 and/or the second side surface 412 may be positioned perpendicular to the top surface 408.

The downstream plate 406 and the upstream plate 404 are attach to the outer shell 402 and more specifically attach to the top surface 408. The upstream plate 404 is positioned oblique to the top surface 408. The downstream plate 406 is positioned oblique to the top surface 408. In other constructions, the upstream plate 404 and the downstream plate 406 may be positioned perpendicular to the top surface 408.

A plurality of first purge holes 414 extend through the upstream plate 404. Purge air 418 passes through the plurality of first purge holes 414 into the resonator interior 312. A plurality of second purge holes 416 extend through the top surface 408. The purge air 418 also passes through the plurality of second purge holes 416 into the resonator interior 312. The purge air 418 is the compressed air from the compressor section 102. In other constructions, the purge air 418 may be from a source other than the compressor section 102. The plurality of second purge holes 416 are arranged on the top surface 408 closer to the upstream plate 404 than to the downstream plate 406. The plurality of first purge holes 414 and the plurality of second purge holes 416 may have the same or different configurations. The configuration may include shape, dimension, etc.

The resonator box 304 is manufactured by press forming as a single piece. In other constructions, the outer shell 402, the upstream plate 404, and the downstream plate 406 may be manufactured as separated pieces, with the upstream plate 404 and the downstream plate 406 welded to the outer shell 402. Additionally, each of the top surface 408, the first side surface 410, the second side surface 412, the upstream plate 404, and the downstream plate 406 may be manufactured as a separated piece and welded together, or the resonator box 304 may be manufactured as a single piece by an additive manufacture process including a layer-by-layer addition of materials, such as would be done using a selective laser melting (SLM) process.

Figure 5:
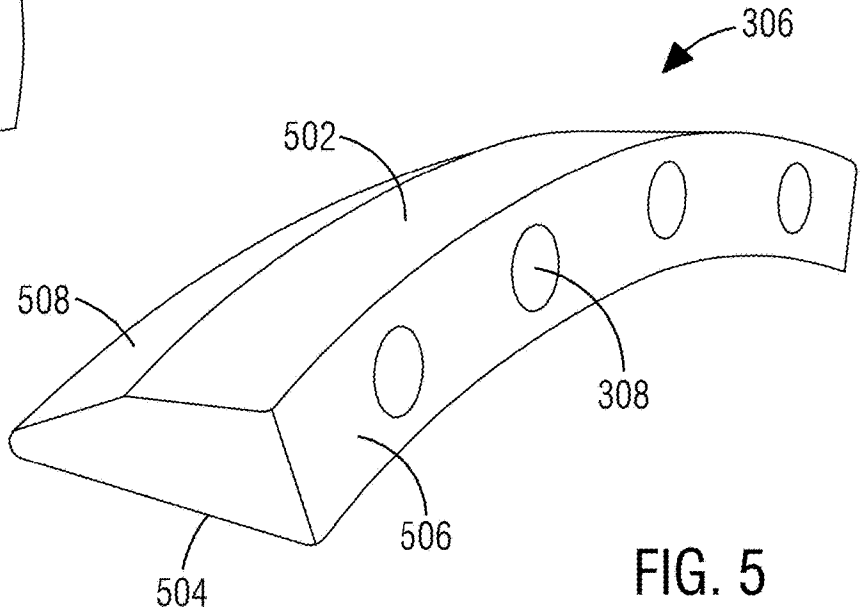
FIG. 5 is a perspective view of a resonator segment of the resonator of FIG. 3.

FIG. 5 illustrates a perspective view of the resonator segment 306 of FIG. 3. The resonator segment 306 has an upper surface 502, a lower surface 504, an upstream surface 506 that extends between the upper surface 502 and the lower surface 504 at an upstream side, and a downstream surface 508 that extends between the upper surface 502 and the lower surface 504 at a downstream side. The upper surface 502, the lower surface 504, the upstream surface 506, and the downstream surface 508 are curved surfaces. The downstream surface 508 is a sloped surface between the upper surface 502 and the lower surface 504.

The plurality of resonator inlets 308 are defined on the upstream surface 506 and evenly distributed on the upstream surface 506. The plurality of resonator outlets 310 are defined on the lower surface 504 (not shown in FIG. 5). With reference to FIG. 3, the plurality of resonator outlets 310 are evenly distributed on the lower surface 504. In other constructions, the plurality of resonator inlets 308 may be unevenly distributed on the upstream surface 506 and/or the plurality of resonator outlet 310 may be unevenly distributed on the lower surface 504.

The resonator segment 306 is manufactured by an additive manufacture process including a layer-by-layer addition of materials, such as a SLM process. In other constructions, the resonator segment 306 may be manufactured by other manufacturing methods, such as forming, machining, etc.

FIG. 6 illustrates a perspective cutout view of a portion of the combustor 120 of FIG. 2. The resonator segment 306 is attached to the wall 202 and more specifically the lower surface 504 is attached to the wall 202. The resonator box 304 is attached to the wall 202 and encloses the resonator segment 306. The upper surface 502 is adjacent to the top surface 408 with a gap therebetween. The gap may be between 0.5 mm to 2 mm, with other dimensions possible. In other constructions, the resonator 208 may be manufactured as a single piece with no gap between the upper surface 502 and the top surface 408. For example, the resonator 208 may be manufactured by an additive manufacture process including a layer-by-layer addition of materials, such as a SLM process. The resonator segment 306 is fully positioned outside of the wall 202.

The plurality of resonator inlets 308 are positioned within the resonator interior 312. As is better illustrated in FIG. 4, the plurality of resonator outlets 310 are positioned on the slot 302. The resonator box 304 is positioned such that the plurality of second purge holes 416 are upstream of the plurality of resonator inlets 308.

The resonator segment 306 has a plurality of resonator necks 602 that are spaced apart from each other. Each resonator neck 602 of the plurality of resonator necks 602 extends from one resonator inlet 308 to a corresponding resonator outlet 310. The resonator neck 602 has a hollow interior that defines a flow path between the resonator inlet 308 and the resonator outlet 310 to guide the purge air 418.

The resonator neck 602 has a curved shape including a first portion 604 and a second portion 606. The first portion 604 extends from the resonator outlet 310 to a turning point 608. The second portion 606 extends from the turning point 608 to the resonator inlet 308. The first portion 604 and the second portion 606 cooperate to define an angle therebetween. The angle is between 15 degrees to 165 degrees. The flow path between the resonator outlet 310 and the resonator inlet 308 is a nonlinear flow path that is defined by a curvature of the resonator neck 602.

The resonator 208 including the resonator box 304 and the resonator segment 306 is made from a material that is different from the wall 202. The material of the resonator 208 has a stronger strength than the material of the wall 202. For example, the resonator 208 may be made from nickel-chromium-based superalloy and the wall 202 may be made from high alloy steel, such as stainless steel. with other suitable materials possible. In other constructions, the resonator 208 including the resonator box 304 and the resonator segment 306 may be made from the same material as the wall 202.

In operation, the purge air 418 enters the resonator interior 312 through the plurality of first purge holes 414 and the plurality of second purge holes 416. The purge air 418 enters each resonator neck 602 from the plurality of resonator inlets 308 and is guided through the nonlinear flow path defined by the resonator neck 602 and is discharged into the combustor interior 204 through the plurality of resonator outlets 310. Each resonator segment 306 including the nonlinear resonator neck 602 is fully positioned outside of the wall 202 without protruding into the combustor interior 204. As such, each resonator 208 has no impact on the fluid 206 in the combustor interior 204 and thus does not affect the aerodynamics of the combustor 120.

In operation, acoustic vibrations occur in the resonator interior 312 when there are pressure fluctuations in the fluid 206 which causes the fluid 206 oscillates passing through the plurality of resonator outlets 310. These vibrations are excited by fluid dynamic mechanism such as Helmholtz resonance and/or Karman oscillations. The purge air 418 dampens the oscillations and the acoustic vibrations. The configuration of the resonator 212, such as the number of resonator necks 602, the size of the resonator necks 602, the shape of the resonator necks 602, etc., are selected to tune the frequency of the resonator 212 to a desired frequency range. The damping effect of the resonators 208 improves dynamics of the combustor 120 while having no impact on the aerodynamics of the combustor 120.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

LISTING OF DRAWING ELEMENTS

100 gas turbine engine
102 compressor section
104 combustion section
106 turbine section
108 inlet section
110 exhaust portion
112 central axis
114 compressor stage
116 stationary compressor vane
118 rotating compressor blade
120 combustor
122 exhaust gas
124 turbine stage
126 stationary turbine vane
128 rotating turbine blade
130 turbine inlet
132 control system
134 rotor
136 flow sleeve
138 combustor liner
140 combustor chamber
142 compressed air plenum
202 wall
204 combustor interior
206 fluid
208 resonator
302 slot
304 resonator box
306 resonator segment
308 resonator inlet
310 resonator outlet
312 resonator interior
402 outer shell
404 upstream plate
406 downstream plate
408 top surface

410 first side surface
412 second side surface
414 first purge hole
416 second purge hole
418 purge air
502 upper surface
504 lower surface
506 upstream surface
508 downstream surface
602 resonator neck
604 first portion
606 second portion
608 turning point

What is claimed is:

1. A combustor comprising:

a wall that defines a combustor interior to receive a fluid;

a slot that extends through the wall; and a resonator coupled to the wall, the resonator comprising:

a resonator box defining a resonator interior between the wall and the resonator box; and a resonator segment disposed within the resonator box, the resonator segment comprising a resonator neck having a resonator inlet and a resonator outlet, the resonator inlet positioned within the resonator interior, the resonator outlet in flow communication with the combustor interior through the slot, the resonator neck defining a nonlinear flow path between the resonator inlet and the resonator outlet, wherein the resonator segment is directly attached to the wall to discharge the fluid from the resonator outlet directly into the combustor interior through the slot, wherein the resonator neck comprises a first portion extending from the resonator inlet to a turning point and a second portion extending from the turning point to the resonator outlet, and wherein the first portion and the second portion cooperate to define an angle that is between 15 degrees to 165 degrees.

2. The combustor of claim 1, wherein the resonator segment is fully positioned outside of the wall.

3. The combustor of claim 1, wherein the resonator box comprises an outer shell, an upstream plate positioned on an upstream side of the outer shell with respect to a flow direction of the fluid, a downstream plate positioned on a downstream side of the outer shell with respect to the flow direction of the fluid, and wherein the outer shell includes a top surface, a first side surface, and a second side surface that cooperate to define a U-shape.

4. The combustor of claim 3, further comprising a plurality of first purge holes that extend through the upstream plate and a plurality of second purge holes that extend through the top surface.

5. The combustor of claim 4, wherein the plurality of second purge holes are arranged upstream of the resonator inlet with respect to the flow direction of the fluid.

6. The combustor of claim 3, wherein the upstream plate is positioned oblique to the top surface, wherein the downstream plate is positioned oblique to the top surface, wherein the first side surface is positioned oblique to the top surface, and wherein the second side surface is positioned oblique to the top surface.

7. The combustor of claim 1, wherein the resonator box and the resonator segment are made from a first material and the wall is made from a second material that is different from the first material.

8. The combustor of claim 1, wherein the resonator segment comprises a plurality of resonator necks, and wherein each resonator neck of the plurality of resonator necks is spaced apart from each other.

9. The combustor of claim 1, wherein the resonator is one of a plurality of resonators, each resonator is arranged circumferentially around the wall and spaced apart from each other.

10. A method for assembling a combustor, the method comprising:

forming a resonator segment comprising a plurality of resonator necks, each resonator neck of the plurality of resonator necks comprising a resonator inlet and a resonator outlet, each resonator neck defining a nonlinear flow path between the resonator inlet and the resonator outlet;

directly attaching the resonator segment on a wall of the combustor, the wall defining a combustor interior to receive a fluid, the wall having a slot extending through the wall, the resonator segment directly attached to the wall to discharge the fluid from the resonator outlet directly into the combustor interior through the slot; and connecting a resonator box to the wall, the resonator segment disposed within the resonator box, the resonator segment and the resonator box cooperating defining a resonator, wherein the resonator neck comprises a first portion extending from the resonator inlet to a turning point and a second portion extending from the turning point to the resonator outlet, and wherein the resonator segment is formed such that the first portion and the second portion cooperate to define an angle that is between 15 degrees to 165 degrees.

11. The method of claim 10, wherein the resonator segment is fully positioned outside the wall.

12. The method of claim 10, wherein the resonator box is press formed as a single piece comprising an outer shell, an upstream plate positioned on an upstream side of the outer shell with respect to a flow direction of the fluid, a downstream plate positioned on a downstream side of the outer shell with respect to the flow direction of the fluid, and wherein the outer shell includes a top surface, a first side surface, and a second side surface that cooperate to define a U-shape.

13. The method of claim 12, further comprises forming a plurality of first purge holes extending through the upstream plate and a plurality of second purge holes extending through the top surface.

14. The method of claim 13, wherein the plurality of second purge holes are formed upstream of the resonator inlet with respect to the flow direction of the fluid.

15. The method of claim 12, wherein the upstream plate is positioned oblique to the top surface, wherein the downstream plate is positioned oblique to the top surface, wherein the first side surface is positioned oblique to the top surface, and wherein the second side surface is positioned oblique to the top surface.

16. The method of claim 10, wherein the resonator box and the resonator segment are made from a first material and the wall is made from a second material that is different from the first material.

17. The method of claim 10, further comprising circumferentially assembling a plurality of resonators around the wall with respect to a combustor central axis and spaced apart from each other.

18. The method of claim 10, wherein the resonator segment is formed using an additive manufacturing process including a layer-by-layer addition of materials.

* * * * *